United States Patent [19]

Smaling

[11] 4,119,414

[45] Oct. 10, 1978

[54] FILTER BAG CONSTRUCTION FOR A VACUUM CLEANER AND METHOD OF OPERATION

[75] Inventor: Oral M. Smaling, Normal, Ill.

[73] Assignee: National Union Electric Corporation, Greenwich, Conn.

[21] Appl. No.: 750,908

[22] Filed: Dec. 15, 1976

[51] Int. Cl.[2] ..... B01D 46/02

[52] U.S. Cl. ..... 55/97; 55/368; 55/371; 55/375; 55/377; 55/380; 55/DIG. 2

[58] Field of Search ..... 55/97, 362, 367, 368, 55/369–371, 376, 377, DIG. 2, 380, 375, 378, 381

[56] References Cited

U.S. PATENT DOCUMENTS

| | | | |
|---|---|---|---|
| 1,923,299 | 8/1933 | Darling | 55/368 |
| 1,999,826 | 4/1935 | Snell | 55/367 |
| 2,039,741 | 5/1936 | Richards | 55/367 |
| 2,566,275 | 8/1951 | White | 55/376 |
| 2,605,493 | 8/1952 | Vance | 55/367 |
| 2,620,045 | 12/1952 | Binggely | 55/367 |
| 2,637,409 | 5/1953 | Turner et al. | 55/371 |
| 2,722,285 | 11/1955 | Brace | 55/368 |
| 2,732,911 | 1/1956 | Gall | 55/368 |
| 2,751,041 | 6/1956 | Cropley | 55/368 |
| 3,479,802 | 11/1969 | Fesco | 55/367 |

*Primary Examiner*—Frank W. Lutter
*Assistant Examiner*—David L. Lacey
*Attorney, Agent, or Firm*—Merriam, Marshall & Bicknell

[57] ABSTRACT

A filter bag construction for filtering dirt, dust and other materials from the exhaust air flow of an upright vacuum cleaner, wherein an elongated, non-disposable outer fabric bag having a longitudinally extending delivery tube therein provides one stage of filtration and a disposable, inner paper filter bag provides a second stage of filtration. The filter bag construction may be used without the inner, paper filter bag when maximum filtration efficiency is not required or with the inner, paper filter bag when high filtration efficiency and/or the convenience of a disposable filter element is desired. When operating as a single stage filter, the upper end of a flow channeling conduit in the lower end of the outer bag is positioned in the lower end of the delivery tube and, when operating as a two-stage filter, the upper end of the conduit is shifted to another position in the outer bag so that unfiltered air from the cleaner is initially channeled into the inner filter bag. The delivery tube of the outer filter bag is of flexible material and terminates above the lower end of the outer bag to facilitate shifting of the flow channeling conduit between its respective positions.

9 Claims, 6 Drawing Figures

FILTER BAG CONSTRUCTION FOR A VACUUM CLEANER AND METHOD OF OPERATION

This invention relates to filters for vacuum cleaners, and more particularly relates to a filter bag construction for a vacuum cleaner which is capable of use either as a single stage filter having a non-disposable filter element requiring periodic cleaning or as a two-stage filter in which the filter element is disposable when filled and replaceable.

Because of the wide variation in the types of rugs, carpets and other floor coverings used in homes, institutions and commercial establishments, vacuum cleaners having different cleaning capabilities and characteristics have been developed to suit the demands of such cleaning situations. In addition, different types of filter constructions have been developed for use with vacuum cleaners employed in different cleaning situations. Thus, while heavy duty or commercial-type upright vacuum cleaners having a non-disposable, cloth fabric filter bag have been and are usually employed to clean rugs and carpets in institutions and commercial establishments, the cleaning requirements, working conditions and personal preferences encountered in some institutions and commercial establishments has required the use of disposable, paper filter bags in such cleaners.

The requirement that the filters of heavy duty or commercial-type vacuum cleaners be capable of operation either as a non-disposable, single stage filter, which can be periodically cleaned, or as a two-stage, higher efficiency filter having the convenience of a disposable paper filter element, is also encountered in the household application of such cleaners.

Accordingly, it is a general object of the present invention to provide a novel filter bag construction which takes into account and satisfies the foregoing requirements and considerations.

A more particular object is to provide a novel filter bag construction for an upright vacuum cleaner, which is capable of operation either as a single stage, non-disposable type filter or as a two-stage, high efficiency filter in which one of the filter elements is disposable.

Another object is to provide a novel filter bag construction for a heavy duty or commercial-type vacuum cleaner employing a non-disposable, outer, cloth filter bag and a disposable, inner, paper filter bag wherein the bag construction may be used either with or without the inner disposable paper bag in accordance with the requirements or circumstances of different cleaning situations.

A specific object is to provide a novel vacuum cleaner filter bag construction of the foregoing character, in which a delivery tube is provided on the inner surface of the outer cloth filter bag for directing the incoming flow of unfiltered air toward the upper end of the outer bag and wherein the lower end of the delivery tube terminates above the lower end of the outer bag to permit a sleeve which supports the disposable inner paper filter bag and through which the unfiltered air passes before entering the outer filter bag to be moved either to a position channeling the incoming unfiltered air into the lower end of the delivery tube or to a position channeling the unfiltered air into the inner, paper filter bag.

A further object is to provide a novel filter bag construction of the character described, which increases the versatility of use and adaptability of upright vacuum cleaners to different cleaning situations, provides two levels of filtering efficiency, and reduces inventory and manufacturing costs.

Other objects and advantages of the invention will become apparent from the following detailed description and accompanying sheets of drawings in which.

Figure 1:
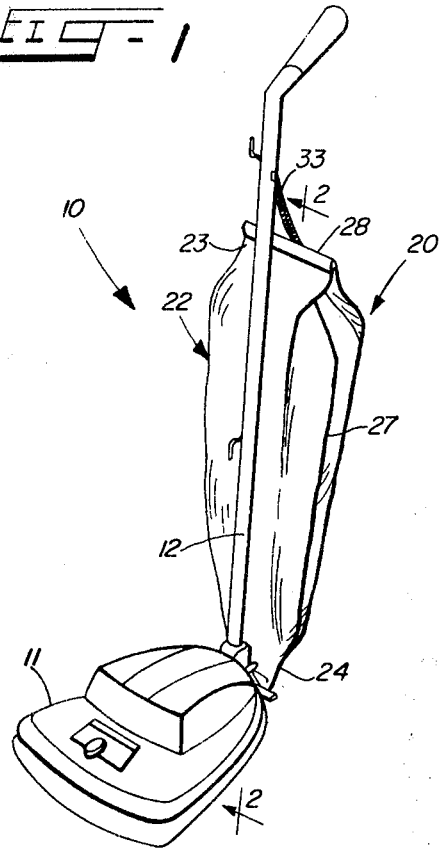
FIG. 1 is a perspective view of an upright vacuum cleaner utilizing a filter bag construction embodying the features of the present invention.

In FIG. 1, a heavy duty or commercial-type upright vacuum cleaner is illustrated and indicated generally at 10. The cleaner 10 is conventional to the extent that it includes a housing 11 having an elongated suction opening or inlet (not shown) extending transversely across the underside thereof, at the front of the housing, and a rotatable brush roll (also not shown) is mounted in a suction chamber above the suction opening and operable to dislodge dirt and other particles resting on or embedded in the surface being cleaned by the cleaner 10. An electrical motor (not shown) mounted in the housing 11 rotates the brush roll and a fan which generates suction at the suction opening and causes a flow of air from the suction opening through the cleaner to an exhaust outlet (also not shown) at the rear of the cleaner when the latter is in operation.

The cleaner 10 also includes a handle 12 that is pivotally connected to the rear of the housing 11 for manipulating the housing over a rug or carpet being cleaned. The handle 12 is movable from the upright position, illustrated in FIG. 1, through a range of rearwardly inclined positions to permit the housing 11 to be moved under chairs, end tables and other low clearance furniture. An elongated filter bag construction, embodying the features of the present invention and indicated generally at 20 in FIG. 1, is carried at the rear of the handle 12 and will now be described.

Figure 2:
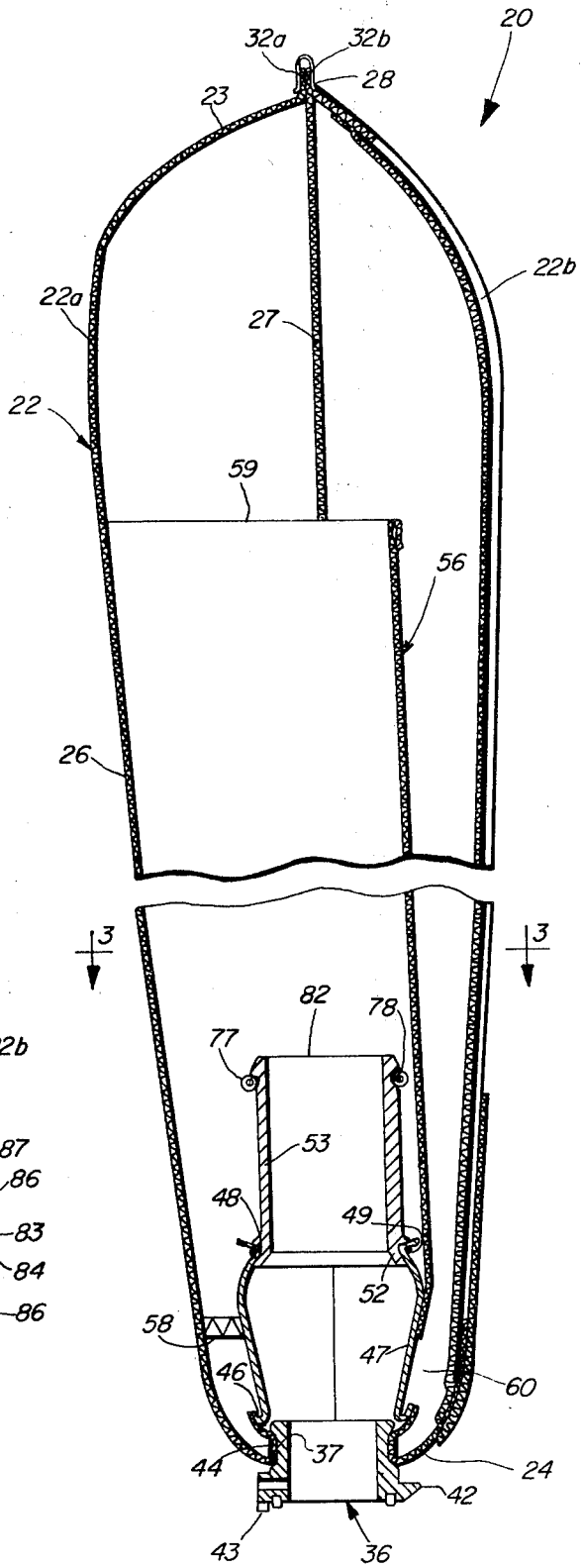
FIG. 2 is an enlarged, broken, longitudinal sectional view of the filter bag construction illustrated in FIG. 1 and showing the arrangement of the parts thereof when the bag is functioning as a single-stage filter.
Figure 3:
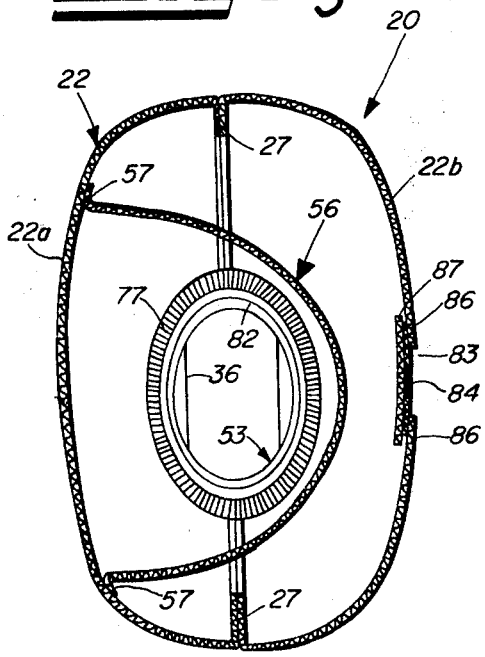
FIG. 3 is a cross sectional view taken substantially along the line 3—3 of FIG. 2.

Referring now to FIGS. 2 and 3 in conjunction with FIG. 1, it will be seen that the filter bag construction 20 comprises an elongated, outer bag 22 having upper and lower ends 23 and 24, respectively, and a peripheral side wall 26. In the present instance, the bag 22 is preferably of a porous, cloth fabric and formed in two halves, namely a front half **22*a* and a rear half 22*b*, which are sewn or otherwise joined together along two laterally spaced, longitudinally extending seams 27** (FIGS. 1 and 3).

The upper end 23 of the bag 22 is not permanently closed but terminates in a pair of transversely extending front and rear marginal edges, indicated at **32*a* and 32*b*, respectively, which are connected by pleated marginal side edges. Thus, the front and rear marginal edges 32*a* and 32*b* are adapted to move toward each other, as shown in FIG. 2, by folding the side edges inwardly, in an accordion-like manner to permit temporary closure of the upper end 23 of the bag. To this end, an elongated clamping member or clip 28, which is generally U-shaped in cross section, is provided for embracing the folded, upper marginal edges 32***a*–32*b* of the bag 22 and holding them in tightly engaged relation with the folded side edges so that little or no air can escape therebetween when the clamp 28 is in place. Strips of sealing material (not shown) may be secured to the inner sides of the front and rear marginal edges 32*a* and 32 *b* to improve the seal, and strips of stiffening material are sewn into the edges 32*a* and 32*b*, and the marginal side edges, to increase the thickness of the edges and thus prevent the clip 28 from being pulled off to the engaged edges. Laterally extending ribs (not shown) are provided on the inner surfaces of the clip 28 to improve retention of the clip with the marginal edges 32*a* and 32*b*. A spring 33 (FIG. 1) connects the clip 28 to the handle 12 and thus supports the upper end 23 of the bag 22.

In order to facilitate connection of the lower end 24 of the bag 22 to the exhaust outlet of the cleaner housing 11, coupling means in the form of a tubular coupling member 36 is secured in an opening 37 in the lower end 24 of the bag 22. Since, in the present instance, the exhaust outlet is oval in cross section, the coupling member 36 is likewise oval in cross section and provided with an indexing lug 42 and a manually swingable latch arm 43 which permits connection and disconnection of the coupling member 36 from the exhaust outlet.

As will be apparent from FIG. 2, the margin of the material at the opening 37 is secured to the coupling member 36 by a strap or ring 44 which clamps the marginal material into a recess in the coupling member 36. Thus, a portion of the coupling member 36 projects outwardly from the lower end 24 of the bag 22 and another portion of the member 36 extends into the interior of the bag. The coupling member 36 thus defines an opening in the lower end 24 of the bag 22 through which unfiltered air from the exhaust outlet of the housing 11 enters the bag.

According to the present invention, the lower end, indicated at 46, of flexible tubular member 47 is secured to the margin of the material of the lower end 24 of the bag, and the upper end, indicated at 48, of the tubular member 47 is secured, as by a wire ring 49 to the lower end, indicated at 52 of a sleeve 53. The sleeve 53, in the present instance, is oval in cross section and is of a suitably strong material, such as high impact styrene or the like. The tubular member 47 and sleeve 53 thus comprise flexible conduit means for channeling the flow of unfiltered air entering the bag 22.

The bag 22 also includes duct means for directing the incoming flow of unfiltered air toward the upper end 23 of the bag 22 and to prevent dirt and other materials already present in the bag from being recirculated while the cleaner is in operation so that premature clogging of the pores of the bag 22 is prevented. Such duct means, in the present instance, comprises an elongated, generally trapezoidally-shaped length of material 56 secured, as by sewing, along two of its laterally spaced side edges 57 (FIG. 3) to the inner surface of the front half 22*a* of the bag 22. Sufficient material is utilized in the delivery tube 56 to accommodate the sleeve 53 and a portion of the tubular member 47, as shown in FIG. 2.

According to the present invention, the lower end, indicated at 58, of the delivery tube 56 terminates above the lower end 24 of the bag 22 so that the sleeve 53 and a portion of the tubular member 47 can be easily shifted between a first position wherein the sleeve and a portion of the tubular member extend into the lower end of the delivery tube 56 and a second position wherein the sleeve 53 and tubular member 47 do not extend into the lower end of the delivery tube 56.

With the foregoing construction and with the tubular member 53 inserted into the lower end of the delivery tube 56, as shown in FIGS. 2 and 3, it will be apparent that, when the cleaner is in operation, dirt and other material dislodged by the cleaner and discharged through the exhaust outlet into the coupling member 36 will flow upwardly through the tubular member 47 and sleeve 53, and into and through the delivery tube 56. The flow will then continue upwardly to the upper end, indicated at 59, of the delivery tube 56 at which point it will discharge into the interior of the bag 22 in a direction toward the upper end 23 thereof.

After discharging out of the upper end 59 of the delivery tube 56, dirt and other materials entrained in the flow will fall downwardly in the bag 22 to be deposited in a quiescent zone, indicated at 60, at the lower end 24 of the bag. Consequently, the pores of the bag 22 do not become prematurely blocked with recirculating dirt and other material which has accumulated from previous cleaning operations.

After sufficient dirt and other materials have collected in the bag 22, such materials may be removed by sliding the clip 28 sideways to disengage the upper end 23 of the bag from the clip and to permit the front and rear marginal edges 32*a* and 32*b* of the bag to separate so that the contents may be removed by dumping the same through the open upper end 23. After the bag has been emptied, the upper end 23 is again closed by folding the pleated side edges of the opening inwardly until the front and rear marginal edges 32*a* and 32*b* and side edges are sandwiched together and then sliding the clip 28 over the sandwiched edges.

Figure 4:
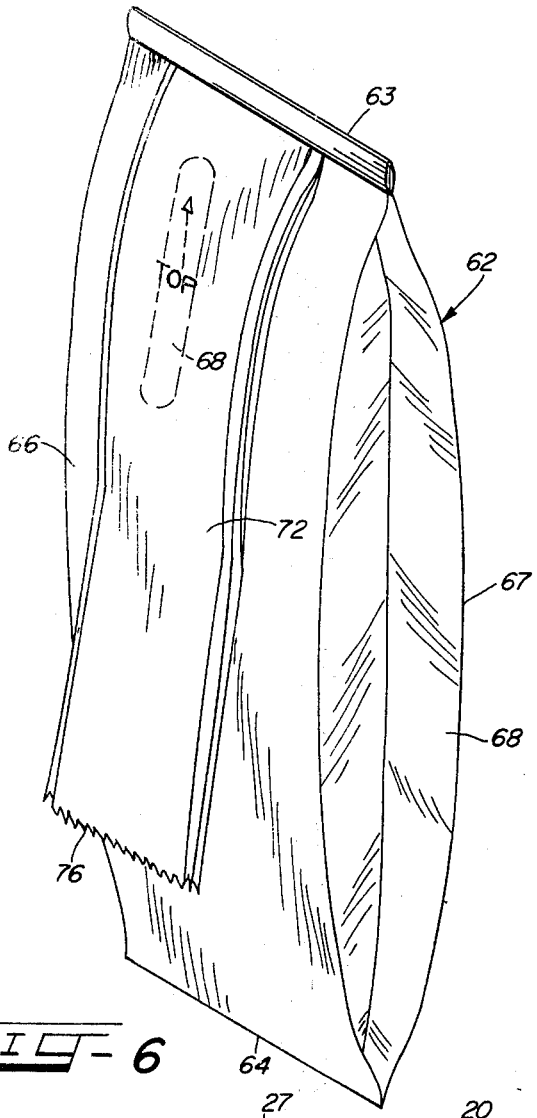
FIG. 4 is a perspective view of the disposable, inner, paper filter bag of the filter bag construction of the present invention.
Figure 5:
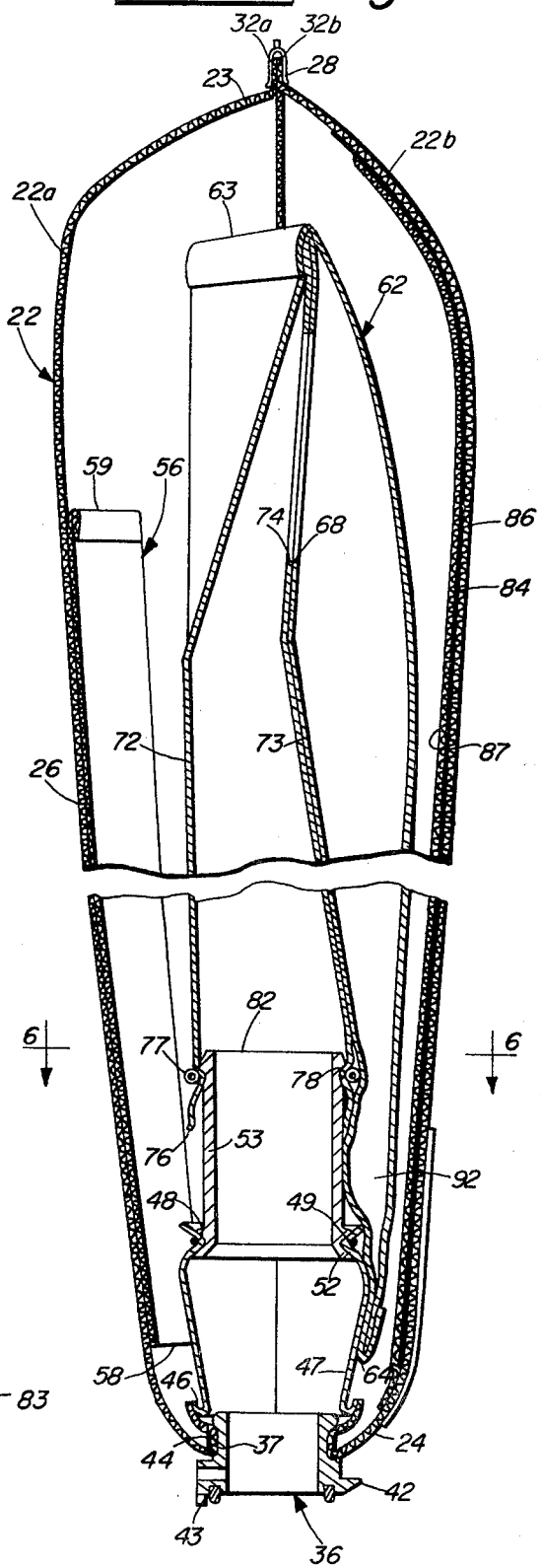
FIG. 5 is a broken, longitudinal sectional view, similar to FIG. 2, of the filter bag construction of the present invention as the latter would appear when the disposable, paper filter bag illustrated in FIG. 4 is mounted therein.
Figure 6:
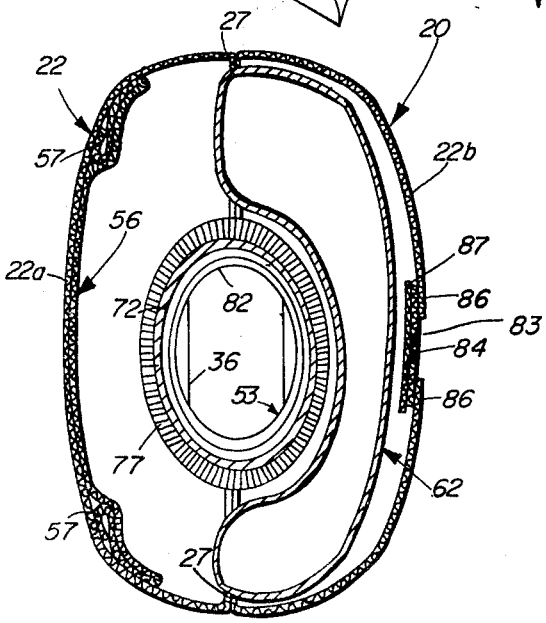
FIG. 6 is a transverse sectional view taken substantially along the line 6—6 of FIG. 5.

Referring now to FIGS. 4–6, inclusive, it will be apparent that the filter bag construction 20 is adapted to function as a two-stage filter, which includes the outer, non-disposable, cloth bag 22 and an inner, disposable, paper filter bag 62. The paper filter bag 62 is of an elongated, generally rectangular shape having upper and lower ends 63 and 64, front and rear faces 66 and 67, respectively, and expansible sides 68. The bag 62 is somewhat shorter than the bag 22 but is expandable therein to substantially fill the interior of the bag 22 when subjected to the pressure of the exhaust air flow from the outlet of the housing 11.

In order to prevent the paper bag 62 from becoming prematurely clogged, the inlet, indicated at 68 in FIGS. 4 and 5 for the bag 62 is located in the front face 66 thereof adjacent to the upper end 63 of the bag and an elongated inlet passage in the form of an expansible delivery tube 72 is secured to the front face 66 of the bag 62 so as to extend downwardly from the upper end 63 thereof toward the lower end 64. The inner or rearward side, indicated at 73, of the delivery tube 72 is secured as by gluing to the forward face 66 and an opening 74 of substantially the same size as the opening 68 is provided in the rear side 73 of the delivery tube 72 to provide communication between the interior of the bag 62 and the delivery tube 72.

The lower end, indicated 76, of the delivery tube 72 is expansible and adapted to extend over the upper end of the sleeve 53, as shown in FIG. 5. A garter spring 77 is mounted on the sleeve 53 and serves to retain the lower end 76 of the delivery tube 72 engaged with the sleeve. To this end, a groove 78 is provided in the outer surface of the sleeve 53 adjacent to the upper end, indicated at 82, for releasably retaining the lower end 76 of the delivery tube 72 on the sleeve. Disengagement of the delivery tube 72 from the sleeve 53 prior to removal of and during installation of a new bag 62 is effected by rolling the garter spring 77 toward the lower end of the sleeve 53 until the spring 77 moves beyond the lower end 76 of the delivery tube.

Access to the interior of the bag 22 to permit inspection and/or removal of the paper filter bag 62 from the cloth bag 22 is provided by an elongated, longitudinally extending opening 83 (FIG. 6) in the rear half 22*b* of the bag 22. A separable closure 84, such as a zipper, is secured as by sewing to the margins, indicated at 86, of the opening 83, and a strip of material 87, preferably the same as that of the bag 22, is sewn to one of the sides of the closure 84 to prevent air leakage through the closure 84.

The filter bag construction 20 operates as follows:

Assuming that the cleaning circumstances or other factors are such that the cleaner 10 is to be operated with one stage of filtration provided by the outer filter bag 22, if it is not already so positioned, the sleeve 53 is inserted into the lower end 58 of the delivery tube 56 in the manner illustrated in FIG. 2. Consequently, the incoming flow of unfiltered air from the exhaust outlet of the cleaner housing 11 will be directed upwardly through the delivery tube 56 toward the upper end 23 of the bag 22. Dirt and other particles entrained in the incoming air flow will thus be directed toward the upper end 23 of the bag 22 and will thereafter settle downwardly in the bag and eventually come to rest in the quiescent zone, indicated at 60 in FIG. 2, at the bottom of the bag 22. Since filtered material remains in the zone 60 and does not circulate when the cleaner 10 is in operation, the pores of the cloth bag 22 do not become prematurely clogged, which might otherwise occur if the flow were not initially directed through the delivery tube 56.

When the bag 22 becomes filled, the contents thereof may be emptied merely by sliding the U-shaped clip 28 laterally until the clip is disengaged from the front and rear marginal edges 32*a* and 32*b* at the upper end 23 of the bag and thereafter emptying the contents of the bag through the open upper end 23. The bag 22 may be completely separated from the housing 11 for this operation by releasing the coupling member 36 from the housing 11.

After the bag 22 has been emptied, the upper end 23 is again closed by folding the pleated side edges inwardly until the front and rear marginal edges 32*a* and 32*b*, and side edges, are sandwiched together, and then sliding the clip 28 over the engaged edges, as illustrated in FIGS. 1 and 2.

When it is desired to utilize the bag 20 as a two-stage filter to obtain the advantages of higher filtration efficiency and a disposable filter element, the disposable, inner paper filter bag 62 is employed. Thus, prior to installing the inner paper filter 62 in the bag 22, the sleeve 53 is shifted downwardly and out of the lower end 58 of the delivery tube 56 so that the latter can fold against the inner surface of the front half 22*a* of the bag 22, as shown in FIG. 6. Thereafter, the lower end 76 of the delivery tube 72 of the paper filter bag 62 is shifted over the upper end 82 of the sleeve 53 and the garter spring 77 is rolled over the overlapping portion of the lower end 76 until it seats in the groove 78 around the upper end of the sleeve. The remainder of the bag is then distributed in the interior of the bag 22 so as to permit the paper bag 62 to expand to its maximum extent when the cleaner is operating.

Since the opening 68 in the upper end of the bag 62 is aligned with the opening 74 at the upper end of the delivery tube 72, dirt and other materials entrained in the air flow from the exhaust outlet of the cleaner will initially be directed upwardly through the delivery tube 72 and thence downwardly in the bag 62 toward a quiescent zone 92 adjacent the lower end 64 (FIG. 5) of the bag. Consequently, the pores of the paper filter bag 62 will not become prematurely clogged with recirculating dirt and other particles present in the bag.

After passing through the pores of the paper filter bag 62, the flow of air is again filtered by the pores of the outer cloth bag 22. Consequently, two stages of filtration are provided, which results in little or no dust, dirt or other material being discharged into the atmosphere. When the inner paper bag 62 is filled, the latter may be removed from the bag 22 and replaced with a new filter by opening the closure 84 and removing the bag 62 therethrough. Prior to this operation, it is, of course, necessary to roll the garter spring 77 downwardly on the sleeve 53 to release the lower end 76 of the delivery tube 72.

The filter bag construction 20 thus permits the cleaner 10 to be operated either with one stage of filtration provided by the outer, cloth filter bag 22 or with two stages of filtration provided by the inner, paper filter bag 62 and outer bag 22. In the latter mode, the disposable advantage of the inner, paper filter bag 62 is also obtained.

While only one embodiment of the invention has been herein illustrated and described in detail, it will be understood that modifications and variations thereof may be effected without departing from the scope of the invention as set forth in the appended claims.

I claim:

1. A filter bag construction for filtering dirt and other materials entrained in the exhaust air flow discharged from the exhaust outlet of a vacuum cleaner, said filter bag construction comprising an elongated, outer, non-disposable filter bag having opposite ends and a peripheral side wall, said outer bag also having an opening in one of said ends and tubular coupling means secured in said opening, said coupling means being adapted to be connected to the exhaust outlet of said cleaner and having a portion extending into said outer bag, said outer bag also having an opening in the other of said ends through which the contents of said bag may be emptied, means for closing said other opening, an inner, porous, disposable filter bag having an opening therein and releasably connected to said portion of said coupling means, said outer filter bag being porous and capable of providing satisfactory filtration of dirt and other materials from the exhaust air flow from said cleaner without said inner, filter bag, the peripheral side wall of said outer bag also having an opening through which said inner bag may be removed and replaced, and means for closing said side wall opening whereby only said outer filter bag need be used when it is desired to provide a filter bag construction having a single stage of filtration in which the contents of the outer bag are periodically emptied by the user and whereby both the outer and inner filter bags are used when it is desired to provide a filter bag construction having two stages of filtration and in which the inner bag is periodically removed and replaced with a new bag when the inner bag is filled or otherwise in need of replacement.

2. The filter bag construction of claim 1, in which said outer filter bag is of porous fabric and said inner filter bag is of porous paper.

3. A filter bag construction having either single or two-stage filtering capability and adapted for use with an upright vacuum cleaner, said cleaner including a housing having a suction inlet, an exhaust outlet, and a handle for manipulating said housing over a rug or carpet to be cleaned, said filter bag construction comprising an elongated, outer bag of flexible, porous material and an inner bag of porous material said outer bag being adapted to be connected to and supported by said handle and having upper and lower ends and a substantially cylindrical side wall, said outer bag also having an opening in the lower end thereof and coupling means mounted in and secured to said opening, said coupling means being tubular and adapted to be connected to the exhaust outlet of said cleaner, duct means in said outer bag and extending longitudinally thereof, said duct means having an upper end opening toward the upper end of said outer bag and a lower end spaced above the lower end of said outer bag, conduit means mounted in said outer bag and having an upper end and a lower end, said lower end of said conduit means being operatively connected to and communicating with said tubular coupling means and adapted to receive unfiltered exhaust air from said cleaner outlet when said cleaner is in operation, at least a portion of said conduit means being flexible so as to permit the upper end of said conduit means to be shifted to a first position wherein the flow of unfiltered air from said exhaust outlet is channeled into the lower end of said duct means and to a second position wherein said flow is channeled directly into the interior of said bag, and the upper end of said conduit means being connected to said elongated, inner bag of porous material when said conduit means is in said second position, whereby said filter bag construction permits said vacuum cleaner to be operated with only one stage of filtration provided by said outer bag when said conduit means is in said first position or with two stages of filtration when said conduit means is in said second position and said inner filter bag is connected thereto.

4. The filter bag construction of claim 3, in which said conduit means includes a rigid sleeve, and a flexible tubular member extends between the lower end of said sleeve and the lower end of said outer bag, whereby said sleeve is shiftable between said first and second positions.

5. The filter bag construction of claim 3, in which said duct means comprises a length of flexible material secured to the inner surface of the side wall of said outer bag and extending lengthwise thereof.

6. The filter bag construction of claim 5, in which the material of said duct means is generally trapezoidally-shaped and has a pair of laterally spaced side edges, said side edges being secured to the inner surface of said outer bag.

7. The filter bag construction of claim 5, in which said flexible material comprises a cloth fabric.

8. A method of operating a filter bag construction for a vacuum cleaner either as a single or two-stage filter, said bag construction including an elongated, porous, outer bag of filtering material having an opening in the lower end thereof and an elongated, flexible delivery tube extending lengthwise in said outer bag and having its lower end terminating above the lower end of said outer bag, said delivery tube being operable to direct unfiltered exhaust air toward the upper end of said outer bag, said opening being adapted to be connected to the exhaust outlet of the cleaner, and a flexible conduit in said outer bag having an upper end an lower end, said lower end being operatively connected to the opening in the lower end of said outer bag so as to be able to receive said unfiltered flow of exhaust air from said cleaner, said method comprising the steps of shifting the upper end of said flexible conduit from a position outside said delivery tube to a position wherein said upper end of said conduit is positioned in the lower end of said delivery tube, and operating said cleaner with the upper end of said flexible conduit positioned in the lower end of said delivery tube to obtain single stage filtration as unfiltered air discharges from the upper end of said delivery tube and passes through the pores of said outer bag.

9. The method of claim 8, wherein said filter bag construction includes an inner porous filter bag positioned in said outer bag, said method including the additional steps of withdrawing the upper end of said flexible conduit from the lower end of said delivery tube, connecting said inner, porous, filter bag to the upper end of said flexible conduit, and operating said cleaner with the unfiltered air initially passing through the pores of said inner filter bag and then through the pores of said outer filter bag to obtain two-stage filtration.

* * * * *